US011696609B2

(12) United States Patent
Cheung

(10) Patent No.: US 11,696,609 B2
(45) Date of Patent: Jul. 11, 2023

(54) PREPARATION METHOD FOR CLOTHING BACK FASTENER

(71) Applicant: Kaiping Leadtheway Hook & Eye Tape Ltd., Kaiping (CN)

(72) Inventor: Suilung Cheung, Kaiping (CN)

(73) Assignee: KAIPING LEADTHEWAY HOOK & EYE TAPE LTD., Kaiping (CN)

( * ) Notice: Subject to any disclaimer, the term of this patent is extended or adjusted under 35 U.S.C. 154(b) by 0 days.

(21) Appl. No.: 17/864,097

(22) Filed: Jul. 13, 2022

(65) Prior Publication Data

US 2022/0338578 A1 Oct. 27, 2022

Related U.S. Application Data

(63) Continuation of application No. 16/913,316, filed on Jun. 26, 2020, now Pat. No. 11,419,372.

(30) Foreign Application Priority Data

Apr. 26, 2019 (CN) ..... 201910344807.X
Apr. 26, 2019 (CN) ..... 201920595009.X

(51) Int. Cl.
*A41F 1/00* (2006.01)

(52) U.S. Cl.
CPC ..... *A41F 1/006* (2013.01)

(58) Field of Classification Search
CPC ..... A41F 1/006
See application file for complete search history.

(56) References Cited

U.S. PATENT DOCUMENTS

| | | | | |
|---|---|---|---|---|
| 7,128,635 | B1 | 10/2006 | Liu | |
| 11,419,372 | B2 * | 8/2022 | Cheung | A41F 1/006 |
| 2002/0068506 | A1 | 6/2002 | Devita | |
| 2004/0221434 | A1 * | 11/2004 | Kaye | A41C 3/12 24/714.2 |
| 2008/0045122 | A1 | 2/2008 | Utaka et al. | |
| 2009/0223029 | A1 * | 9/2009 | Leung | A41F 1/006 83/13 |
| 2019/0357636 | A1 | 11/2019 | Utaka et al. | |

FOREIGN PATENT DOCUMENTS

CN 201640559 U 11/2010

* cited by examiner

*Primary Examiner* — Gloria M Hale
(74) *Attorney, Agent, or Firm* — Muncy, Geissler, Olds & Lowe, P.C.

(57) ABSTRACT

A preparation method for a clothing back fastener includes weaving a cylindrical webbing with a mechanical weaving method, cutting the cylindrical webbing into a plurality of units with two ends open, closing one end to form an outer sleeve bag with one end open, and providing a plurality of slits on the outer sleeve bag; sewing a plurality of fasteners on the surface of a cloth strip, and cutting the cloth strip into a plurality of units to form a lining cloth; disposing the lining cloth in the outer sleeve bag in a sleeved mode, and inserting the fasteners into respect slit to be located outside the outer sleeve bag, and fixing the outer sleeve bag and the lining cloth. The method further includes attaching a hot melt film on the lining cloth to thermally bond the outer sleeve bag and the lining cloth to achieve fixed connection therebetween.

20 Claims, 8 Drawing Sheets

PREPARATION METHOD FOR CLOTHING BACK FASTENER

CROSS REFERENCE TO RELATED APPLICATION

The present application is a continuation Application of U.S. application Ser. No. 16/913,316, filed on Jun. 26, 2020, now U.S. Pat. No. 11,419,372, which claims priority from Chinese Patent Applications No. 201910344807.X and 201920595009.X filed on Apr. 26, 2019, all of which are hereby incorporated herein by reference.

TECHNICAL FIELD

The present invention relates to the field of clothing, particularly relates to a preparation method for a clothing back fastener, which is particularly applied to underwear connectors.

BACKGROUND

The existing underwear connector, including an eye tape and a hook tape which are matched with each other, is sewn at the ends of the underwear strap. The eye tape includes a front side and a back side. The front side of the eye tape is provided with a plurality of rows of eye fasteners, and the back side of the eye tape is attached to the skin of the human body. During the processing of the existing eye tapes, the eye fasteners are directly sewn to the eye tape by using fabric tapes, resulting in rows of sewing seams on the rear side of the eye tape, which affects the appearance of bra. Moreover, due to the existence of the sewing seams, the back of a user may appear marks in the shape of sewing seam accordingly when using the bra, which also affects the user experience. Worse still, the user will feel discomfort when the uneven sewing seams touch and rub the skin for a long time.

In order to improve the above-mentioned situation, CN 2016 40559 U discloses a seamless reverse binding back fastener, which includes a base body having an inner lining cloth and multiple rows of eye fasteners. A piece of strip cloth covers the base body. The front portion of the cloth covers the front side of the base body, and the rear portion of the cloth is reversed to cover the rear side of the base body. The left and right sides of the cloth are respectively connected with the left and right sides of the inner lining cloth by sewing. The sewing opening at the joining portion of the sewing seam is reversely folded to be placed within the inner chamber formed by the cloth. Such back fastener has the advantages of being good in appearance effect and comfortable to wear without damaging the skin. However, both the left and right sides of the fastener still need to be connected by sewing in processing. Meanwhile, the sewing opening of the sewing seam needs to be reversely folded to be placed within the inner chamber formed by the cloth, more manufacture procedures are thus needed, and the left and right sides of the back buckle are thicker than the middle portion, thereby affecting the wearing feeling of the user.

SUMMARY

The present invention thus provides a preparation method for a seamless clothing back fastener. The seamless clothing back fastener in this method is prepared with a simple process, which will be more comfortable during wearing and simultaneously have a better visual perception and experience feeling.

The clothing back fastener according to the present invention includes a lining cloth and an outer sleeve bag. According to the preparation method, the outer sleeve bag is directly formed by weaving with silk threads instead of being formed by sewing an existing piece of cloth. A cylindrical webbing is formed by directly weaving with a mechanical weaving method through a cylindrical weaving machine. The cylindrical webbing is then cut into a plurality of units with two ends open and one end of each unit is closed, the outer sleeve bag is thus formed with one end open. A plurality of slits are provided on a surface of the outer sleeve bag. A plurality of fasteners are provided on a surface of a cloth strip. The cloth strip is then cut into a plurality of units to form a lining cloth. During assembling, the lining cloth is disposed in the outer sleeve bag in a sleeved mode, and each fastener is correspondingly inserted into respect slit to be located outside the outer sleeve bag. Finally, the outer sleeve bag and the lining cloth are fixedly connected.

According to the present invention, the lining cloth is completely covered with the outer sleeve bag, so that only the outer sleeve bag is in direct contact with the user. The outer sleeve bag is a cylindrical bag formed by directly weaving with the silk thread, so that there is no sharp seam on both sides thereof. That is, the side surface of the outer sleeve bag in contact with the user is in smooth transition. Therefore, not only the thick and solid feeling caused by the seam is reduced, but also the uncomfortable caused by tightening marks, friction, etc. due to the seam is avoided, thereby increasing comfort during use. There is also no possibility that clothing will be scrapped due to the crack of the seam.

In addition, the outer sleeve bag of the present invention is a cylindrical cloth bag directly formed by weaving, such as silk thread, through a device especially the cylindrical weaving machine, so that the outer sleeve bag with different colors can be woven only by selecting silk threads of different colors, and the outer sleeve bag of different patterns can also be interwoven with silk threads of different colors. That is, the outer sleeve bag with a plurality of colors or patterns, such as alternating colors, a zebra style, flower gray, and rainbow color, can be obtained by a simple silk thread replacement process. The clothing back fastener prepared in this way thus also has a strong adaptability, which greatly enriches the style and beauty of the back fastener, thereby satisfying the women's pursuit of beauty.

According to at least one embodiment of the present invention, the cylindrical webbing is ultrasonically cut and sealed one end to form the outer sleeve bags with one end open.

According to at least one embodiment of the present invention, the cloth strip is thermally cut into the units to form the lining cloth.

According to at least one embodiment of the present invention, the fasteners on the lining cloth and the slits on the outer sleeve bag are correspondingly arranged in arrays.

According to at least one embodiment of the present invention, the slits are formed by laser cutting or ultrasonic cutting.

According to at least one embodiment of the present invention, the fasteners are hook fasteners or eye fasteners.

According to at least one embodiment of the present invention, the fasteners are sewn on the surface of the lining cloth.

According to at least one embodiment of the present invention, the method further includes providing a hot melt film on the lining cloth, which is used for bonding the lining cloth and the outer sleeve bag.

According to at least one embodiment of the present invention, the method further includes hot-pressing the hot film to bond the outer sleeve bag to the lining cloth.

According to at least one embodiment of the present invention, the hot melt film attached to the cloth strip before the lining cloth is cut.

According to at least one embodiment of the present invention, the method further includes forming a slit opening in at least one end of the opening end of the outer sleeve bag, which is used for connecting a clothing body.

According to at least one embodiment of the present invention, the slit opening is disposed by laser cutting or scissor cutting.

The present invention further provides a preparation method for another clothing back fastener. The clothing back fastener includes a lining cloth and an outer sleeve bag. A cylindrical webbing is formed by directly weaving with a mechanical weaving method. The cylindrical webbing is then cut into a plurality of units with two ends open. One end of each unit is closed to form the outer sleeve bag with one end open. A plurality of slits are provided in one side of the outer sleeve bag. A hot melt film is attached to a surface of a cloth strip, and a plurality of fasteners are provided on the surface of the cloth strip. The cloth strip is then cut into a plurality of units to form the lining cloth. The lining cloth is disposed in the outer sleeve bag in a sleeved mode, and each fastener is correspondingly inserted to respect slit to be located on the outer surface of the outer sleeve bag. Finally, the outer sleeve bag is bonded to the lining cloth by hot-pressing.

According to the present invention, the hot melt film is provided on the surface of the lining cloth, the lining cloth thus is seamlessly connected to the outer sleeve bag by thermal bonding, which further reduces the thick and solid feeling caused by the seam, thereby increasing comfort during wearing.

According to at least one embodiment of the present invention, the cylindrical webbing is ultrasonically cut and sealed one end to form the outer sleeve bag with one end open.

According to at least one embodiment of the present invention, the cloth strip is thermally cut into the units to form the lining cloth.

According to at least one embodiment of the present invention, the fasteners on the lining cloth and the slits on the outer sleeve bag are correspondingly arranged in arrays.

According to at least one embodiment of the present invention, the slits are formed by laser cutting or ultrasonic cutting.

According to at least one embodiment of the present invention, the fasteners are hook fasteners or eye fasteners.

According to at least one embodiment of the present invention, the fasteners are sewn on the surface of the lining cloth.

According to at least one embodiment of the present invention, the method further includes forming a slit opening in at least one side of the opening end of the outer sleeve bag, which is used for connecting a clothing body.

DETAILED DESCRIPTION

Figure 1:
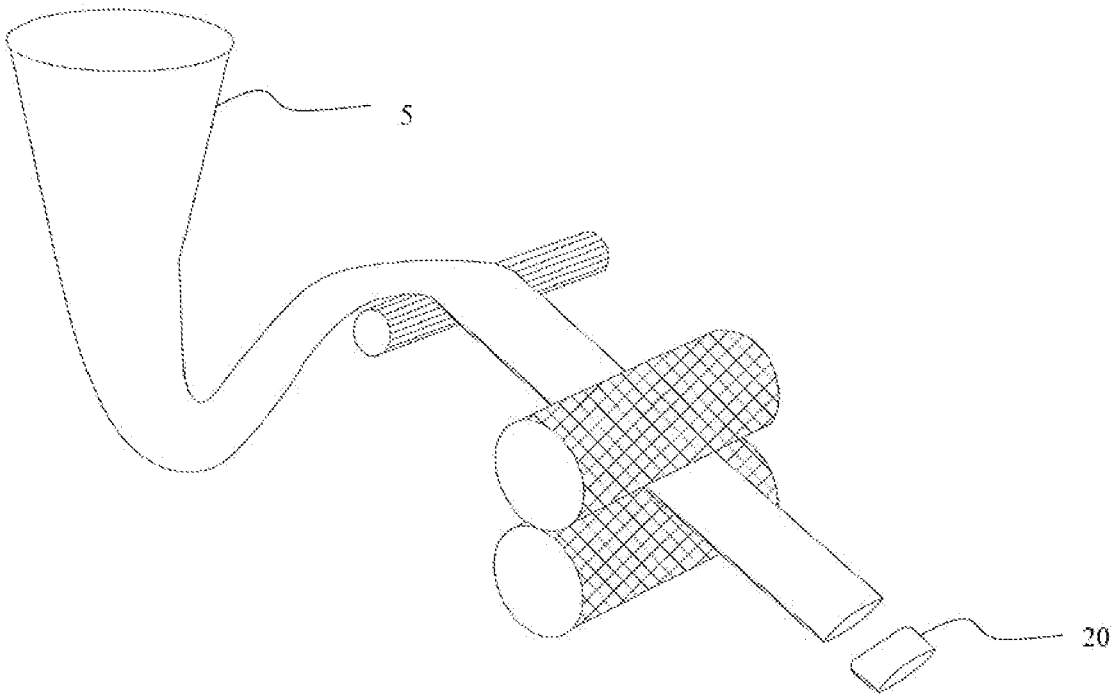
FIG. 1 is a schematic diagram of a preparation process of an outer sleeve bag according to one embodiment of the present invention.

The accompanying drawings of the present invention are only used for exemplary illustration, and should not be understood as limiting the present invention. In order to better illustrate the following embodiments, some parts in the drawings may be omitted, enlarged or reduced, and do not represent the size of the actual product; for those skilled in the art, it is understandable that some well-known structures and their descriptions in the drawings may be omitted.

Figure 14:
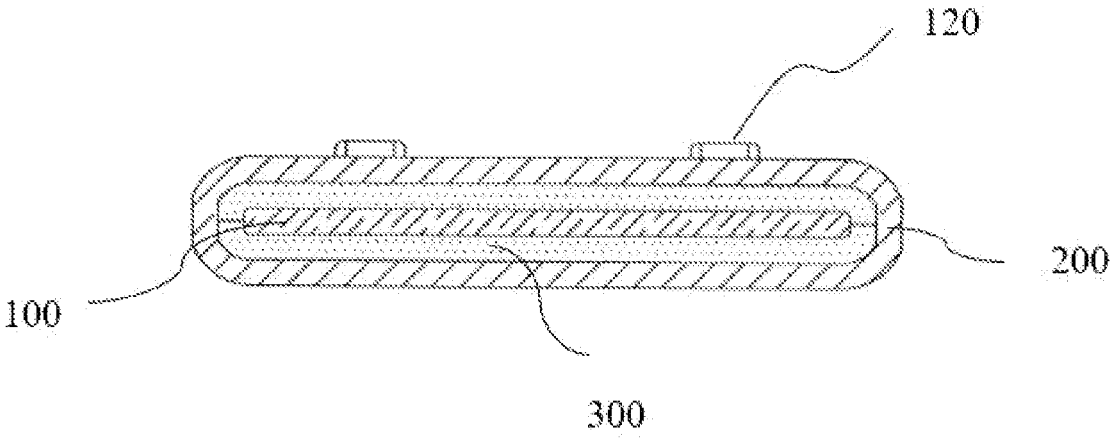
FIG. 14 is a schematic cross-sectional structure diagram after the outer sleeve bag and the lining cloth provided with the hot melt film are combined according to another embodiment of the present invention.
Figure 15:
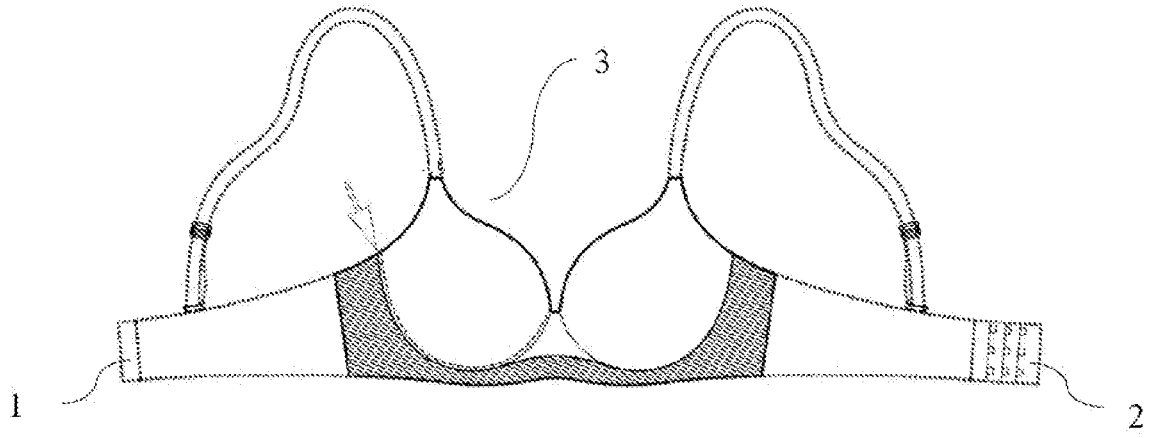
FIG. 15 is a structural schematic diagram showing the clothing back fastener being connected with a clothing body

The drawings illustrate a preparation method for a clothing back fastener provided with fasteners. The fasteners may be hook fasteners or eye fasteners. FIGS. 1-7 illustrate a preparation method for a clothing back fastener 1 in hook tape with hook fasteners, FIGS. 8-14 illustrate a preparation method for a clothing back fastener 2 in eye tape with eye fasteners, and FIG. 15 illustrates the application of the clothing back fastener 1 in hook tape and the clothing back fastener 2 in eye tape in underwear 3. Although only the clothing back fastener with hook fasteners and eye fasteners are shown, the design concept of the present invention is applicable to the preparation of male and female fasteners in other types.

As shown in FIGS. 1-7, the clothing back fastener 1 in hook tape includes a lining cloth 10 and an outer sleeve bag 20. The fasteners used in this embodiment are hook fasteners 11. Referring to FIG. 1, the outer sleeve bag 20 is of a bag-like structure that is formed by mechanically weaving with weaving material, such as silk threads, directly through a cylindrical weaving machine, instead of being formed by folding and sewing a piece of cloth. The silk thread is woven into a cylindrical webbing 5 by a cylindrical weaving machine. In order to make the outer sleeve bag 20 in small unit, the cylindrical webbing 5 is cut and sealed one end to form a plurality of units with one end open. Each of the plurality of units is the outer sleeve bag 20 in the shape of a cylindrical cloth bag. The webbing 5 may be cut by any cutting method, such as mechanical cutting, ultrasonic cutting, and laser cutting. The cutting and sealing of the outer sleeve bag 20 can be done in one step or in two steps, i.e. cutting first and then sealing. According to a preferred embodiment of the present invention, the cutting and sealing of the outer sleeve bag is done in one step, i.e. the sealing is done simultaneously with the cutting, which can be achieved by ultrasound. The outer sleeve bag 20 prepared with this method is a cylindrical cloth bag, therefore no sharp fracture or seam exist on both sides of the outer sleeve bag, avoiding to cause sharp edges and rough surfaces which results inconvenience to the user.

Figure 2:
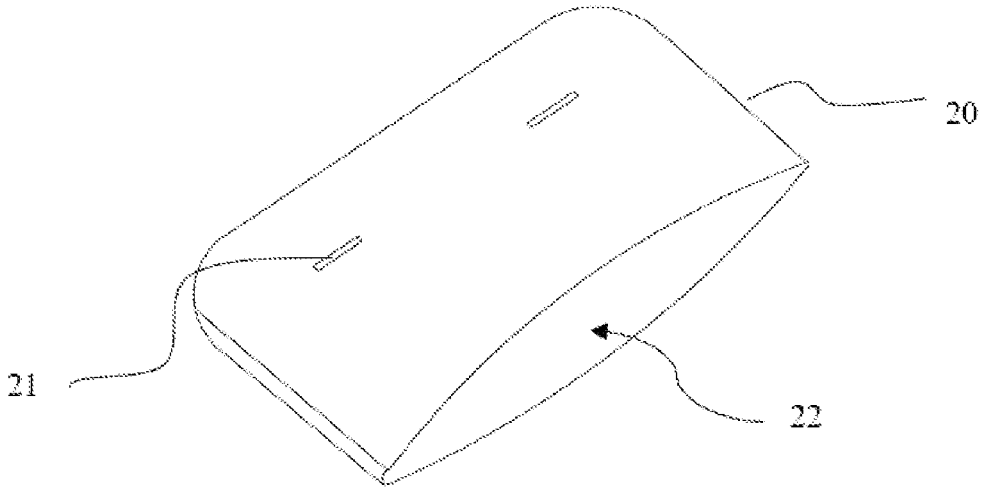
FIG. 2 is a structural schematic diagram of the outer sleeve bag according to one embodiment of the present invention.

Referring to FIG. 2, a plurality of slits 21 are provided on one surface of the outer sleeve bag 20. Each slit is used for receiving respect hook fastener 11. According to a preferred embodiment of the present invention, the slit 21 is formed by laser cutting, but other cutting methods, such as mechanical cutting or ultrasonic cutting, may also be adaptable.

Figure 3:
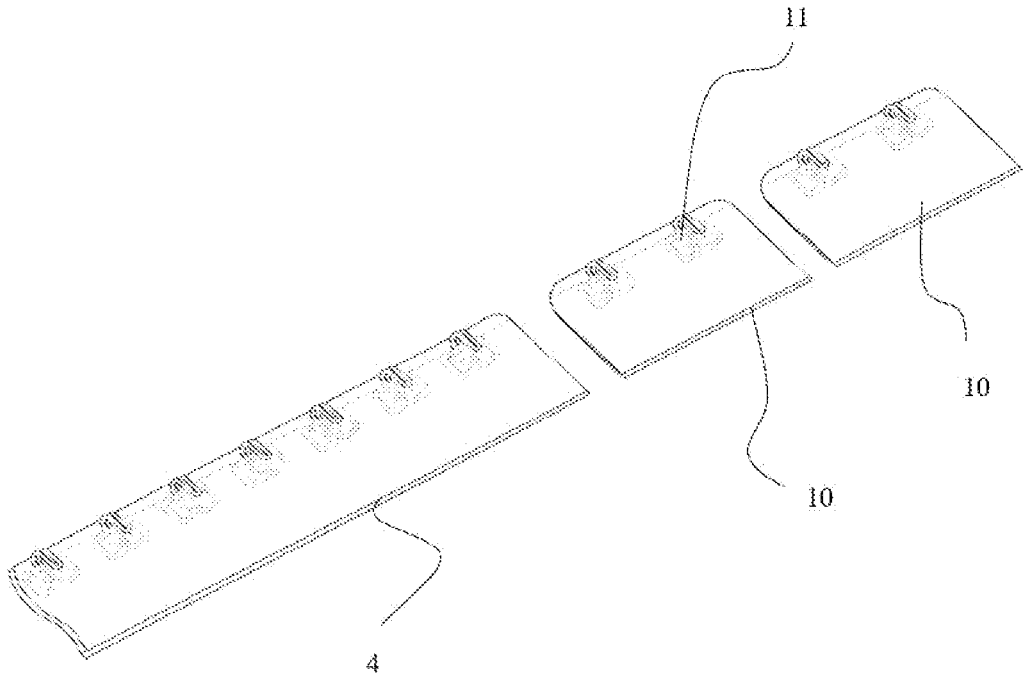
FIG. 3 is a schematic diagram of a preparation process of a lining cloth according to one embodiment of the present invention.

FIG. 3 shows a preparation method for the lining cloth 10. A plurality of hook fasteners 11 are provided on a cloth strip 4, and then the cloth strip 4 is cut into a plurality of units, each unit namely is one lining cloth 10. According to a preferred embodiment of the present invention, the hook fastener 11 is sewn on the surface of the lining cloth 10. The hook fastener 11 is composed of a metal wire or all materials which can be twist-formed and have a certain hardness (such as an encapsulated iron wire and a stainless-steel material), which, however, is not limited to these two materials.

In order to increase the structural strength of the lining cloth 10, the lining cloth 10 may also be designed into a multi-layer structure, for example, a reinforcing layer is disposed in the middle to play a certain supporting role, so that the hook fastener 11 can be much better to fix to the lining cloth 10.

Figure 4:
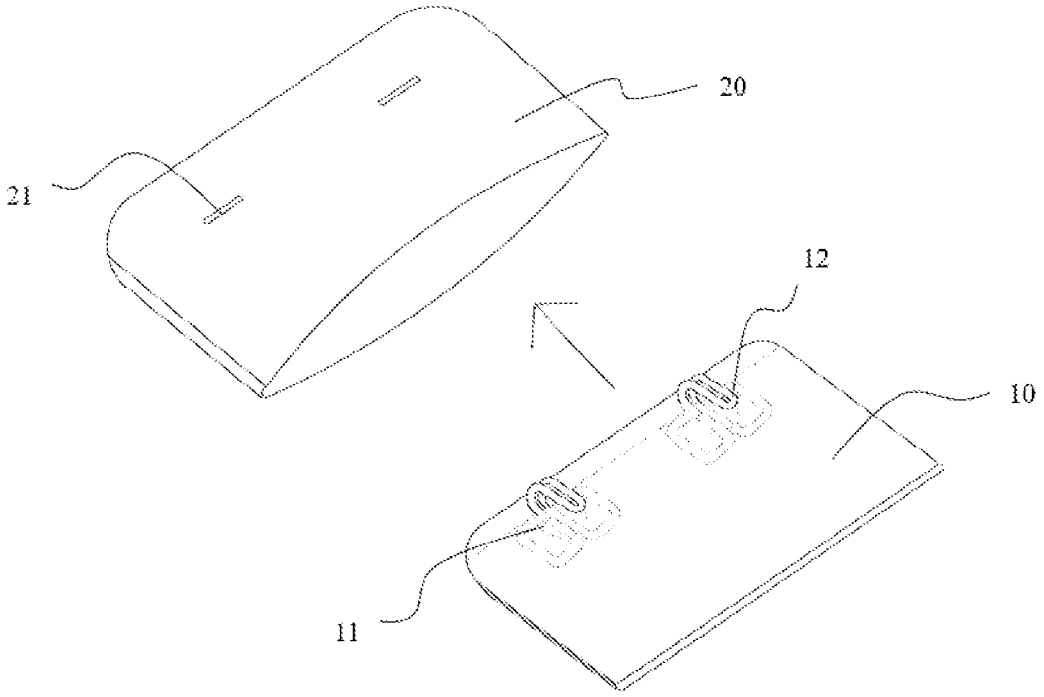
FIG. 4 is a schematic diagram of a combination process of the outer sleeve bag and the lining cloth according to one embodiment of the present invention.
Figure 5:
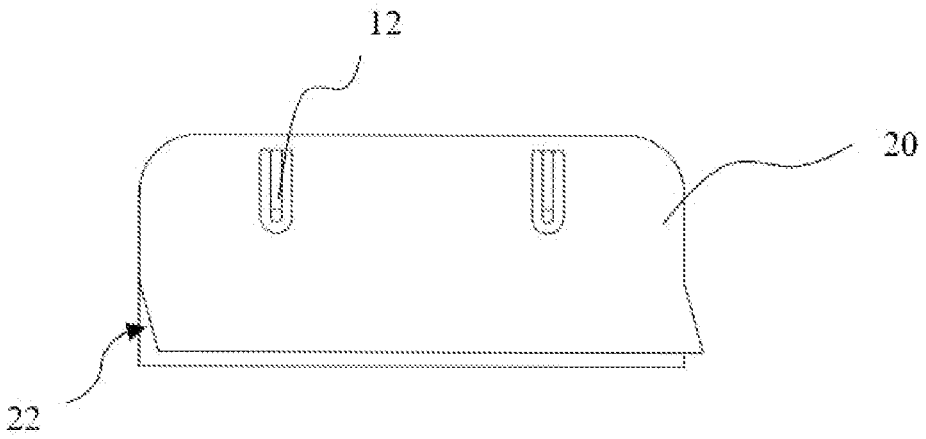
FIG. 5 is a structural schematic diagram after the outer sleeve bag and the lining cloth are combined according to one embodiment of the present invention.

Referring to FIG. 4 and FIG. 5, the prepared lining cloth 10 is disposed in the outer sleeve bag 20 in a sleeved mode. The hook fastener 11 correspondingly penetrates through respect slit 21 of the outer sleeve bag 20, so that the outer end portion 12 of the hook fastener 11 is exposed to the outer surface of the outer sleeve bag 20, and the lining cloth 10 is fixedly connected to the outer sleeve bag 20. The lining cloth 10 thus is completely covered the outer sleeve bag 20 in a simple manner.

Figure 6:
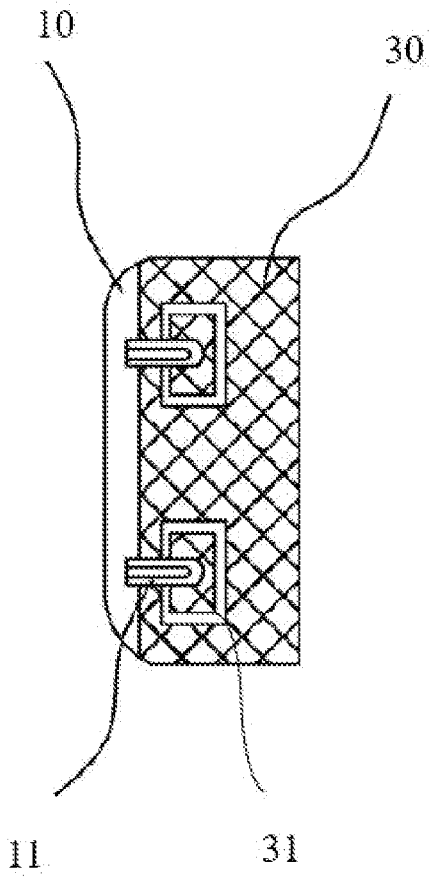
FIG. 6 is a structural schematic diagram of the lining cloth according to one embodiment of the present invention, in which the lining cloth is provided with a hot melt film.
Figure 7:
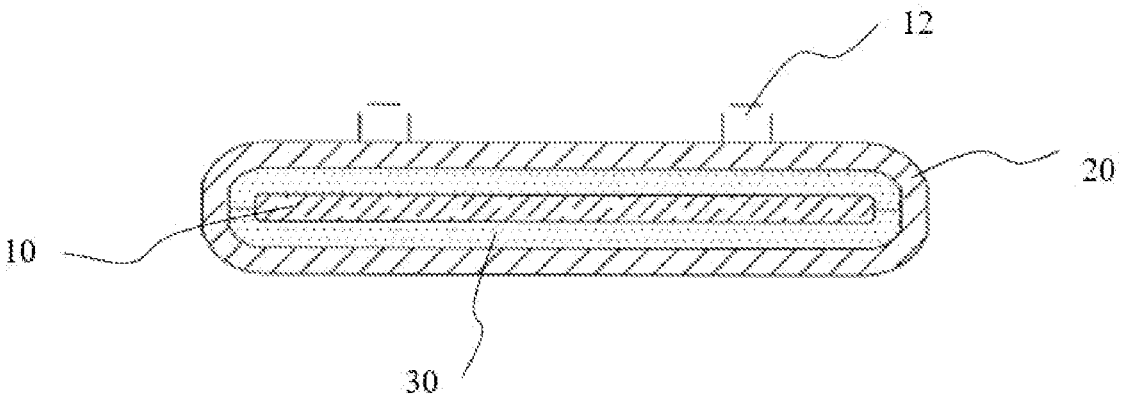
FIG. 7 is a schematic cross-sectional structure diagram after the outer sleeve bag and the lining cloth provided with the hot melt film are combined according to one embodiment of the present invention.

According to at least one embodiment of the present invention, as shown in FIG. 6 and FIG. 7, the outer sleeve bag 20 and the lining cloth 10 are fixedly connected by thermal bonding. Specifically, a hot melt film 30 is provided on a surface of the lining cloth 10. The hot melt film may be provided on the upper and lower surfaces of the lining cloth 10 thereof at the same time, or the hot melt film may be only disposed on one surface thereof. After the lining cloth 10 is disposed in the outer sleeve bag 20 in the sleeved mode, an ironing machine is used for ironing the sleeve bag 20, the hot melt film 30 thus is hot-pressed and heated to be molten, so that the outer sleeve bag 20 is bonded to the upper and lower surfaces of the lining cloth 10. By this method, the lining cloth 10 is seamlessly connected to the outer sleeve bag 20, thereby reducing the thick and solid feeling caused by the seam and making the user more comfortable during wearing. FIG. 7 shows a sectional diagram after the outer sleeve bag 20 is bonded to the lining cloth 10, which shows that the outer sleeve bag 20 is bonded to the upper and lower surfaces of the lining cloth 10, so that the outer sleeve bag 20 and the lining cloth 10 are integrally formed to have a better fixing function. According to a preferred embodiment of the present invention, the hot-melting film 30 is attached to one surface of the cloth strip 4 before the lining cloth 10 is cut.

According to a preferred embodiment of the present invention, the hook fasteners 11 are arranged in an array, each lining cloth 10 is provided with at least one row of hook fasteners 11, and each row are provided with at least two hook fasteners 11. The slits 21 on the outer sleeve bag 20 are disposed in the same manner as the hook fastener 11, which are also arranged in an array. Each outer sleeve bag 20 is provided with at least one row of slits2*l*, and each row is provided with at least two slits 21. Referring to FIGS. 2-4, the hook fasteners 11 have the same array arrangement as the slits 21, the lining cloth 10 and the outer sleeve bag 20 are correspondingly disposed, the lining cloth 10 is provided with two hook fasteners 11 in one row, and the outer sleeve bag 20 is provided with two slits 21 in one row.

In order to facilitate connection with the clothing body, a slit opening 22 is formed in at least one side of the opening end of the outer sleeve bag 20. Referring to FIG. 7, according to a preferred embodiment of the present application, both sides of the opening of the outer sleeve bag 20 are each provided with a slit opening 22 to connect a clothing body, such as an underwear. The slit opening 22 can be formed by laser cutting or scissor cutting.

Figure 8:
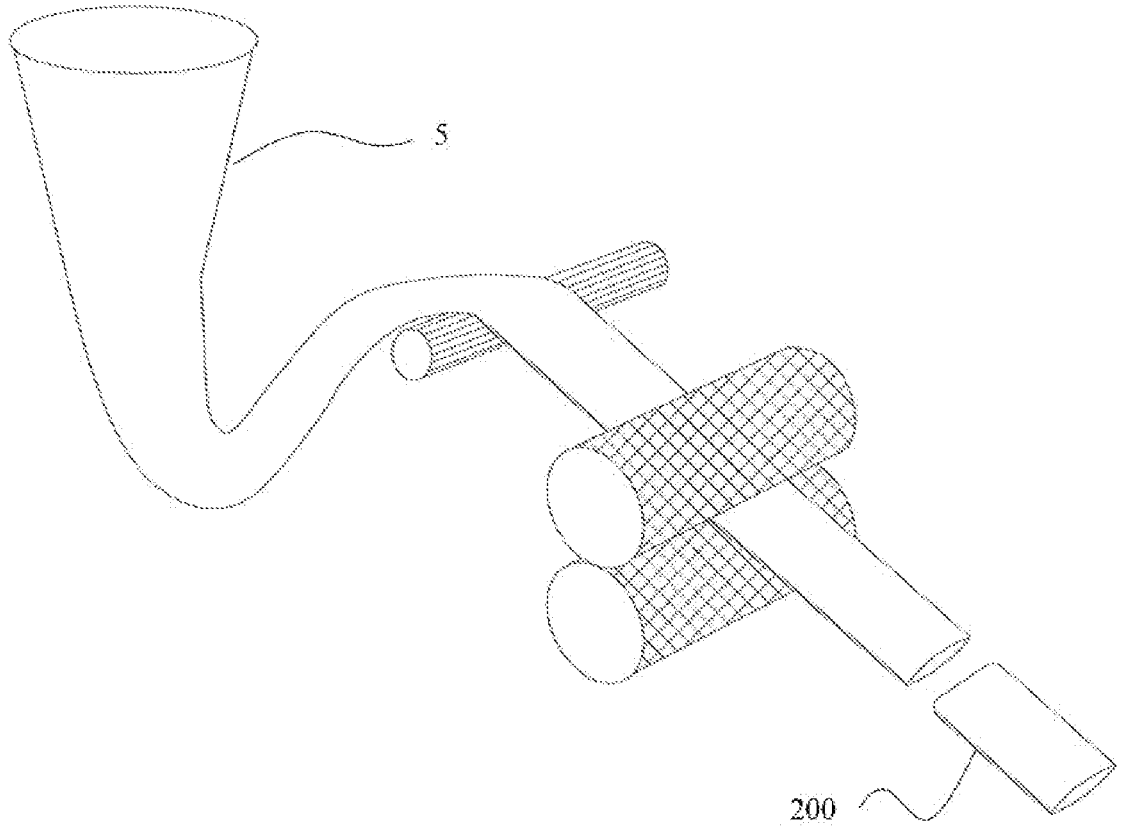
FIG. 8 is a schematic diagram of a preparation process of an outer sleeve bag according to another embodiment of the present invention.

The preparation method for the clothing back fastener 2 in eye tape as shown in FIGS. 8-14 is basically the same as the preparation method for the clothing back fastener 1 in hook tape as shown in FIGS. 1-7, a lining cloth 100 and an outer sleeve bag 200 are included, and fasteners are eye fasteners 110. Referring to FIG. 8, the outer sleeve bag 200 is of a bag-like structure that is formed by mechanically weaving with weaving material directly, such as silk threads, instead of being formed by folding and sewing a piece of cloth. The silk thread is woven into a cylindrical webbing 5 by a cylindrical weaving machine. In order to make the outer sleeve bag 200 in small units, the webbing 5 is cut and sealed to form a plurality of units with one end open. each of the plurality of units is the outer sleeve bag 200 which is a cylindrical cloth bag. The webbing 5 may be cut by any cutting method, such as mechanical cutting, ultrasonic cutting, and laser cutting. The cutting and sealing of the outer sleeve bag 200 can be done in one step or in two steps, i.e. cutting first and then sealing. According to a preferred embodiment of the present invention, the cutting and sealing of the outer sleeve bag 200 is done in one step, i.e. the sealing is done simultaneously with the cutting, which can be achieved by ultrasound. The outer sleeve bag 200 prepared with this method is a cylindrical cloth bag, therefore no sharp fracture or seam exist on both sides of the outer sleeve bag 200, avoiding to cause sharp edges and rough surfaces, which can result inconvenience to the user.

Figure 9:
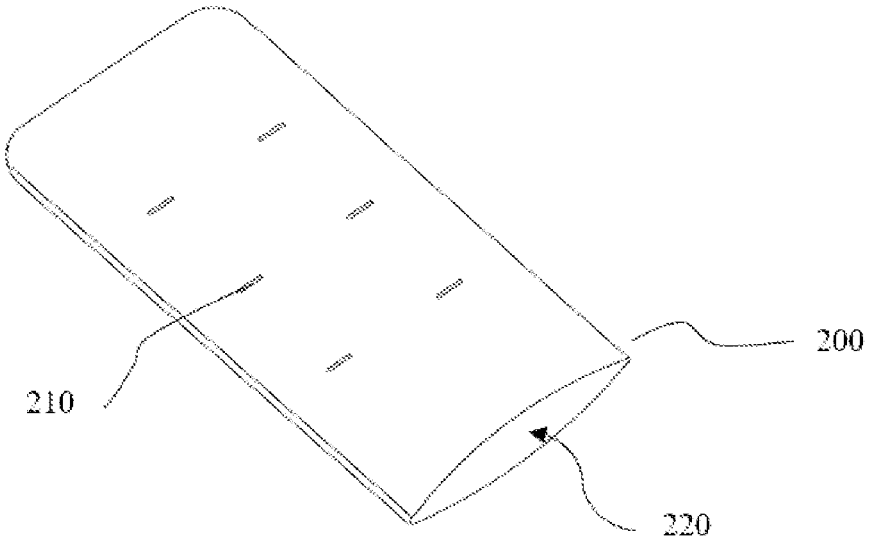
FIG. 9 is a structural schematic diagram of the outer sleeve bag according to another embodiment of the present invention.

Referring to FIG. 9, a plurality of slits 210 are provided on one surface of the outer sleeve bag 200. Each slit is used for receiving the respect eye fastener 110. According to a preferred embodiment of the present invention, the slits 210 are formed by laser cutting, but other hole forming methods, such as mechanical hole forming or ultrasonic hole forming, may also be adaptable.

Figure 10:
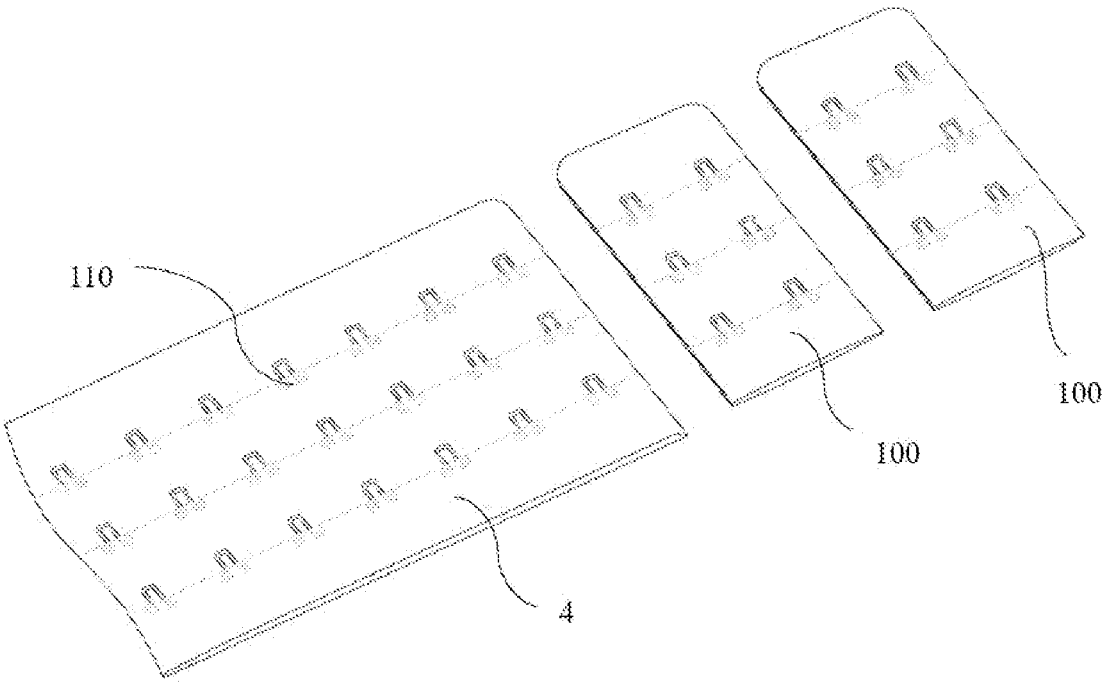
FIG. 10 is a schematic diagram of a preparation process of a lining cloth according to another embodiment of the present invention.

FIG. 10 shows a preparation method for the lining cloth 100. A plurality of eye fasteners 110 are disposed on a cloth strip 4, and the cloth strip 4 is then cut into a plurality of units, each unit namely is one lining cloth 100. According to a preferred embodiment of the present invention, the eye fasteners 110 are sewn on the surface of the lining cloth 100. The eye fasteners 110 are composed of a metal wire or all materials which can be twist-formed and have a certain hardness (such as an encapsulated iron wire and a stainless-steel material), which, however, is not limited to these two materials.

In order to increase the structural strength of the lining cloth 100, the lining cloth 100 may also be designed into a multi-layer structure, for example, a reinforcing layer is disposed in the middle to play a certain supporting role, so that the eye fastener 110 can be much better to fix to the lining cloth 100.

Figure 11:
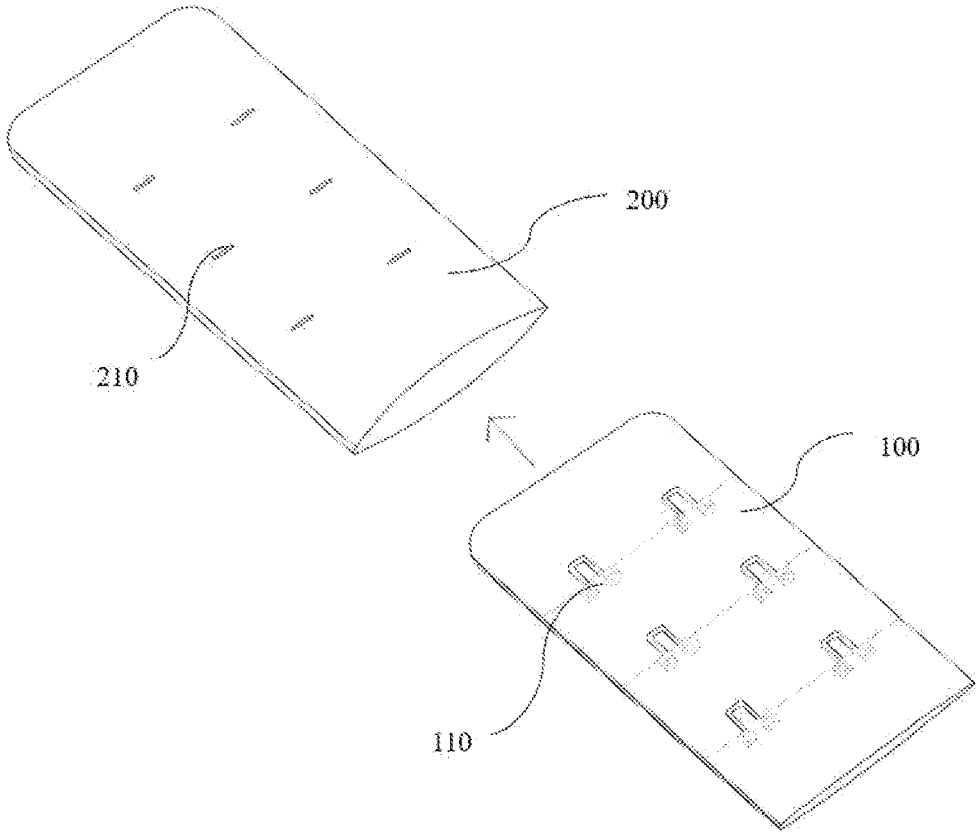
FIG. 11 is a schematic diagram of a combination process of the outer sleeve bag and the lining cloth according to another embodiment of the present invention.
Figure 12:
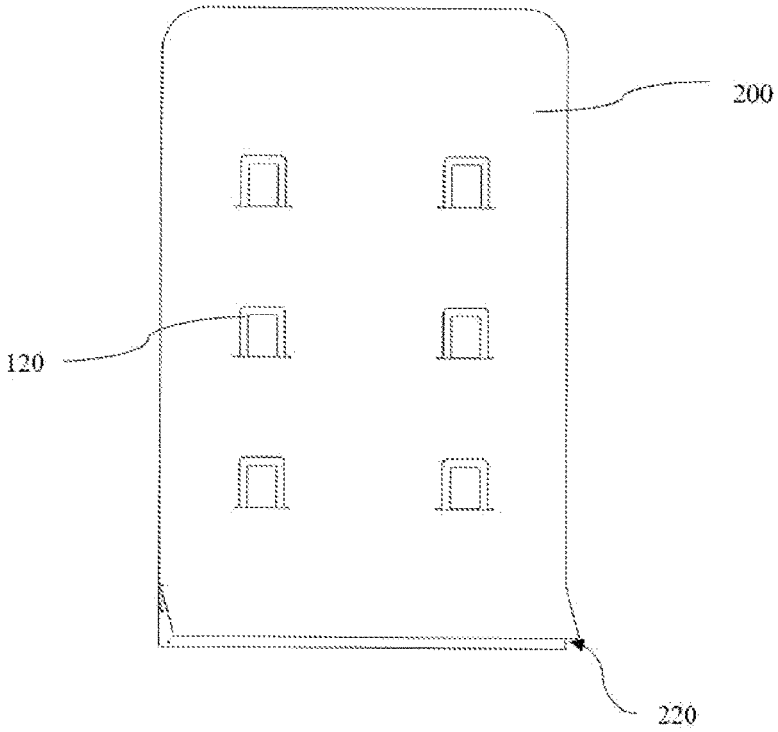
FIG. 12 is a structural schematic diagram after the outer sleeve bag and the lining cloth are combined according to another embodiment of the present invention.

Referring to FIG. 11 and FIG. 12, the prepared lining cloth 100 is disposed in the outer sleeve bag 200 in a sleeved mode. The eye fasteners 110 correspondingly penetrates through the respect slit 210 of the outer sleeve bag 200, so that the outer end portion 120 of the eye fasteners 110 is exposed to the outer surface of the outer sleeve bag 200. The lining cloth 100 is finally fixedly connected to the outer sleeve bag 200. The lining cloth 100 according to the present embodiments is thus completely covered in the outer sleeve bag 200 in a simple manner.

Figure 13:
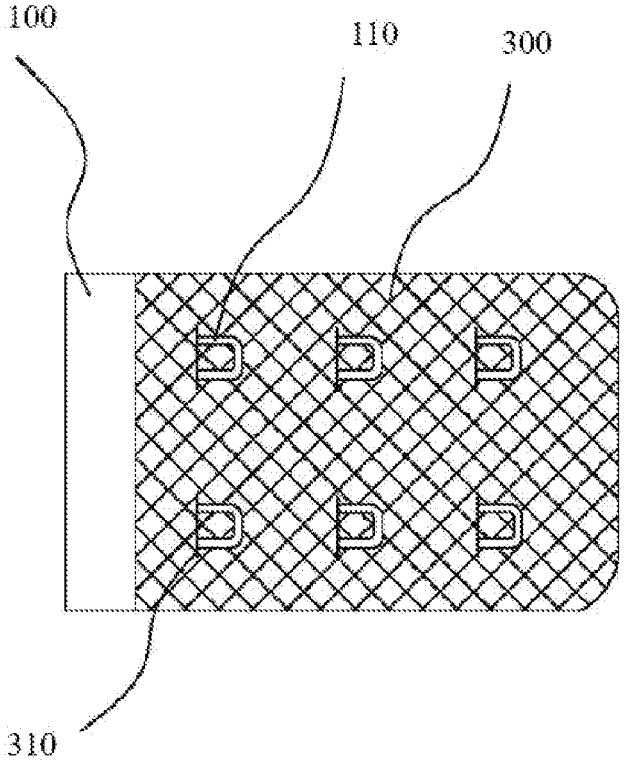
FIG. 13 is a structural schematic diagram of the lining cloth according to another embodiment of the present invention, in which the lining cloth is provided with a hot melt film.

According to a preferred embodiment of the present invention, as shown in FIG. 13, the outer sleeve bag 200 and the lining cloth 100 are fixedly connected by thermal bonding. Specifically, a hot melt film 30 is provided on a surface of the lining cloth 100. The hot melt film may be disposed on the upper and lower surfaces of the lining cloth 100 thereof at the same time, or the hot melt film may be only disposed on one surface thereof. After the lining cloth 100 is disposed in the outer sleeve bag 200 in the sleeved mode, an ironing machine is used for ironing the sleeve bag 200, the hot melt film 300 is hot-pressed and heated to be molten, so that the outer sleeve bag 200 is bonded to the upper and lower surfaces of the lining cloth 100. By this method, the lining cloth 100 is seamlessly connected to the outer sleeve bag 200, thereby reducing the thick and solid feeling caused by the seam and making the user more comfortable during wearing. FIG. 14 shows a sectional diagram after the outer sleeve bag 200 is bonded to the lining cloth 100, which shows that the outer sleeve bag 200 is bonded to the upper and lower surfaces of the lining cloth 100, so that the outer sleeve bag 200 and the lining cloth 100 are integrally formed to have a better fixing function. According to a preferred embodiment of the present invention, the hot melt film 300 is attached to one surface of the cloth strip 4 before the lining cloth 100 is cut.

According to a preferred embodiment of the present invention, the eye fasteners 110 are arranged in an array, each lining cloth 10 is provided with at least two rows of eye fasteners 110 in order to be applicable to users in different sizes, and at least two eye fasteners 110 are provided in each row. The hole forming seams 210 on the outer sleeve bag 200 are disposed in the same manner as the eye fasteners 110, which are also arranged in an array. Each outer sleeve bag 200 is provided with at least two rows of slits 210, and at least two slits 210 are provided in each row. Referring to FIGS. 9-13, the eye fasteners 110 have the same array arrangement as the slits 210. The lining cloth 100 and the outer sleeve bag 200 are correspondingly disposed, the lining cloth 100 is provided with three rows of eye fasteners 110 and two eye fasteners 110 are in each row. Similarly, the outer sleeve bag 200 is provided with three rows of slits210 and each row has two slits 210.

In order to facilitate connection with the clothing body, a slit opening 220 is formed in at least one side of the opening end of the outer sleeve bag 200. Referring to FIG. 12, according to a preferred embodiment of the present application, both ends of the opening end of the outer sleeve bag 200 are each provided with a slit opening 22 to connect the clothing body. The slit opening 220 can be formed by laser cutting or scissor cutting.

The steps involved in the preparation method for the above-mentioned clothing back fasteners 1 and 2 can be conducted in any order according to needs.

The clothing back fastener 1 in hook tape and clothing back fastener 2 in eye tape can be used at the same time or separately as needed. FIG. 15 shows both applied to the underwear 3 simultaneously. According to the clothing back fasteners 1, 2 prepared by the above-mentioned method, the lining cloth 10, 100 is completely covered by the outer sleeve bag 20, 200. That is, only the outer sleeve bag 20, 200 is in direct contact with the user. The outer sleeve bag 20, 200 is in form of a cylindrical bag formed by directly weaving with the silk thread, so that there is no seam on both sides of the outer sleeve bag 20, 200. That is, the side surface of the outer sleeve bag 20, 200 in contact with the user has a smooth transition. Therefore, the user feels more comfortable during wearing, and there is no possibility that clothing will be scrapped due to the crack of the seam.

According to the conventional method, the outer sleeve bag is formed by sewing an existing cloth strip, the color and pattern of the outer sleeve bag thus are limited by the existing cloth, and it is difficult to achieve that the outer sleeve bag has many different colors and patterns. The outer sleeve bag 20, 200 prepared by this method is a form of cylindrical cloth bag formed by directly weaving with weaving material, such as the silk thread, so that the color and pattern of the outer sleeve bag 20, 200 can be changed at any time, a plurality of different colors and patterns can also be achieved at the same time only by replacing the silk thread as needed. The clothing back fasteners 1 and 2 thus prepared also have a strong adaptability to satisfy women's pursuit of beauty.

What's more, the lining cloth 10, 100 can be provided with a hot melt film 30, 300, so that the lining cloth 10, 100 and the outer sleeve bag 20, 200 are seamlessly connected by thermal bonding via the hot melt film 30, 300, which further reduces the thick and solid feeling caused by the seam and make the user feels more comfortable during wearing.

Obviously, the above-mentioned embodiments of the present invention are only examples for clearly illustrating the technical solutions of the present invention, and are not intended to limit the specific embodiments of the present invention. Any modifications, equivalent replacements, improvements, etc. made within the spirit and principles of the claims of the present invention shall be included within the protection scope of the claims of the present invention.

The invention claimed is:

1. A preparation method for a clothing back fastener, wherein the clothing back fastener includes a lining cloth and an outer sleeve bag, the preparation method comprises:

preparation for the outer sleeve bag, including weaving a cylindrical webbing by a mechanical weaving method, cutting the cylindrical webbing into a plurality of units with two ends open, sealing one end of each unit to form the outer sleeve bag with one opening end, and providing a plurality of slits on a surface of the outer sleeve bag;

preparation for the lining cloth, including providing a plurality of fasteners on a surface of a cloth strip, and cutting the cloth strip into a plurality of units, each unit being the lining cloth; and preparation for assembling the lining cloth and the outer sleeve bag, including disposing the lining cloth in the outer sleeve bag in a sleeved mode, and inserting each fastener into respect slit to be located outside the outer sleeve bag, and fixing the outer sleeve bag and the lining cloth.

2. The preparation method according to claim 1, wherein the cylindrical webbing is ultrasonically cut and sealed to form the outer sleeve bag with one opening end.

3. The preparation method according to claim 1, wherein the cloth strip is thermally cut into the plurality of units to form the lining cloth.

4. The preparation method according to claim 1, wherein the plurality of fasteners on the lining cloth and the plurality of slits on the outer sleeve bag are correspondingly arranged in arrays.

5. The preparation method according to claim 1, wherein the plurality of slits are formed by laser cutting or ultrasonic cutting.

6. The preparation method according to claim 1, wherein the plurality of fasteners are hook fasteners or eye fasteners.

7. The preparation method according to claim 1, wherein the plurality of fasteners are sewn on the surface of the lining cloth.

8. The preparation method according to claim 1, wherein the method further comprises providing a hot melt film on a surface of the lining cloth, the hot melt film is configured for bonding the lining cloth and the outer sleeve bag.

9. The preparation method according to claim 8, wherein the method further comprises hot-pressing the hot melt film to bond the outer sleeve bag to the lining cloth.

10. The preparation method according to claim 8, wherein the hot melt film is attached to the lining cloth before the lining cloth is cut.

11. The preparation method according to claim 1, wherein the method further comprises forming a slit opening in at least one side of the opening end of the outer sleeve bag, the slit opening is configured for connecting a clothing body.

12. The preparation method according to claim 1, wherein the slit opening is formed by laser cutting or scissor cutting.

13. A preparation method for a clothing back fastener, wherein the clothing back fastener included a lining cloth and an outer sleeve bag, the preparation method comprises:

preparation for the outer sleeve bag, including weaving a cylindrical webbing by a mechanical weaving method, cutting the cylindrical webbing into a plurality of units with two ends open, sealing one end of each unit to form the outer sleeve bag with one opening end, and providing a plurality of slits on a surface of the outer sleeve bag;

preparation for the lining cloth, including attaching a hot melt film to a cloth strip, and providing a plurality of fasteners on the cloth strip, and cutting the cloth strip into a plurality of units, each unit being the lining cloth; and preparation for assembling the lining cloth and the outer sleeve bag, including disposing the lining cloth in the outer sleeve bag in a sleeved mode, and inserting each fastener into respect slit to be located outside the outer sleeve bag, and hot-pressing the outer sleeve bag to bond to the lining cloth.

14. The preparation method according to claim 13, wherein the cylindrical webbing is ultrasonically cut and sealed to form the outer sleeve bag with one opening end.

15. The preparation method according to claim 13, wherein the cloth strip is thermally cut into the plurality of units to form the lining cloth.

16. The preparation method according to claim 13, wherein the plurality of fasteners on the lining cloth and the plurality of slits are correspondingly arranged in arrays.

17. The preparation method according to claim 13, wherein the plurality of slits are formed by laser cutting or ultrasonic cutting.

18. The preparation method according to claim 13, wherein the plurality of fasteners are hook fasteners or eye fasteners.

19. The preparation method according to claim 13, wherein the plurality of fasteners are sewn on the surface of the lining cloth.

20. The preparation method according to claim 13, wherein the method further comprises forming a slit opening in at least one side of the opening end of the outer sleeve bag, the slit opening is configured for connecting a clothing body.

* * * * *